United States Patent [19]

Logan et al.

[11] 3,974,020

[45] Aug. 10, 1976

[54] CARPET MAKING MACHINE

[75] Inventors: Robert Logan, Glasgow; Adam McGregor, Stewarton, both of Scotland

[73] Assignee: British Carpets Ltd., Glasgow, Scotland

[22] Filed: July 5, 1974

[21] Appl. No.: 485,786

[30] Foreign Application Priority Data

Aug. 8, 1973 United Kingdom ..... 37682/73

[52] U.S. Cl. ..... 156/435; 156/72

[51] Int. Cl.[2] ..... D04H 11/00

[58] Field of Search ..... 156/72, 435, 265, 298, 156/519, 562, 287; 139/7 A, 7 C, 7 D; 28/76 P, 72 P, 79 R

[56] References Cited

UNITED STATES PATENTS

| | | | |
|---|---|---|---|
| 1,970,524 | 8/1934 | Knowland et al. | 139/7 C |
| 3,531,343 | 9/1970 | Couquet | 156/435 |
| 3,847,691 | 11/1974 | Currell | 156/435 |
| 3,864,190 | 2/1975 | Coates | 156/72 |

*Primary Examiner*—William A. Powell
*Assistant Examiner*—Michael W. Ball
*Attorney, Agent, or Firm*—Burgess Ryan and Wayne

[57] ABSTRACT

A machine for making carpeting in which rows of lengths of yarn are bonded to an adhesive surface of a backing web has a gripper station at which yarn ends are presented in a row and are drawn out a predetermined distance, the drawn length of yarn being engaged to support them and then cut off. The cut lengths are then transferred to an assembly station where they are placed on the adhesive surface of the backing. The yarn lengths are pressed against the adhesive surface by a bladed member. The means engaging the drawn yarn lengths to support them comprises, in a preferred version, a bar extending along one side of the row of yarn ends and provided with a multiplicity of pins for impaling the yarn lengths, and a bar on the other side of the row with holes corresponding to the pins for pressing the yarn lengths on to the pins. The means for engaging the drawn yarn lengths may alternatively comprise a bar with holes in it and a device for applying suction to the holes to hold the yarn lengths against the bar by suction.

8 Claims, 10 Drawing Figures

CARPET MAKING MACHINE

This invention relates to the manufacture of carpeting of the kind sometimes known as bonded carpeting, i.e. having a pile adhering to a backing.

According to this invention there is provided a machine for manufacturing carpeting comprising means for presenting ends of yarn in a row at a gripper station, means for releasably gripping the row of yarn ends at said station, means for moving the gripping means and presenting means one away from the other to draw the ends out to a predetermined extent, means for engaging the drawn lengths of the yarn in a sense to support them, means for cutting the drawn lengths of yarn at the side of the engaging means remote from the gripping means, means for moving the engaging means between the gripper station and an assembly station where said lengths of yarn supported by the engaging means each have an end implanted in an adhesive surface of a web of backing material, means being provided at the assembly station for pressing said ends of the lengths of yarn into engagement with said adhesive surface, thereby to form carpeting.

In a preferred embodiment of the invention, the other end of each of said lengths of yarn carried by the engaging means is implanted in an adhesive surface of a second web of backing material which, at the assembly station, is disposed with its adhesive surface facing that of the first said web. Double-plush carpeting is thus formed which can subsequently be divided into two webs of single-plush carpeting.

In preferred constructions according to the invention, the engaging means is oscillated between the gripper station and the assembly station.

According to a preferred feature of the invention the means for engaging the drawn portions of yarn comprises a transfer bar provided with pins for impaling the drawn lengths of yarn. In one such construction the pins project perpendicularly from a surface of the transfer bar, and the bar co-operates with a back-up member which provides a surface provided with apertures or recesses for accommodating the pins, the transfer bar and the back-up member being initially disposed at opposite sides of the drawn lengths of yarn and being movable into and out of engagement with each other at the gripper station, the engaging movement ensuring that the back-up member presses the drawn yarn lengths fully on to the pins. Preferably the cutting-off of the drawn lengths of yarn is carried out whilst they are held between the back-up member and the transfer bar.

According to another preferred feature of the invention, means is provided at the assembly station for restraining the impaled lengths of yarn carried to the assembly station from return movement to the gripper station with the engaging means.

Figure 1:
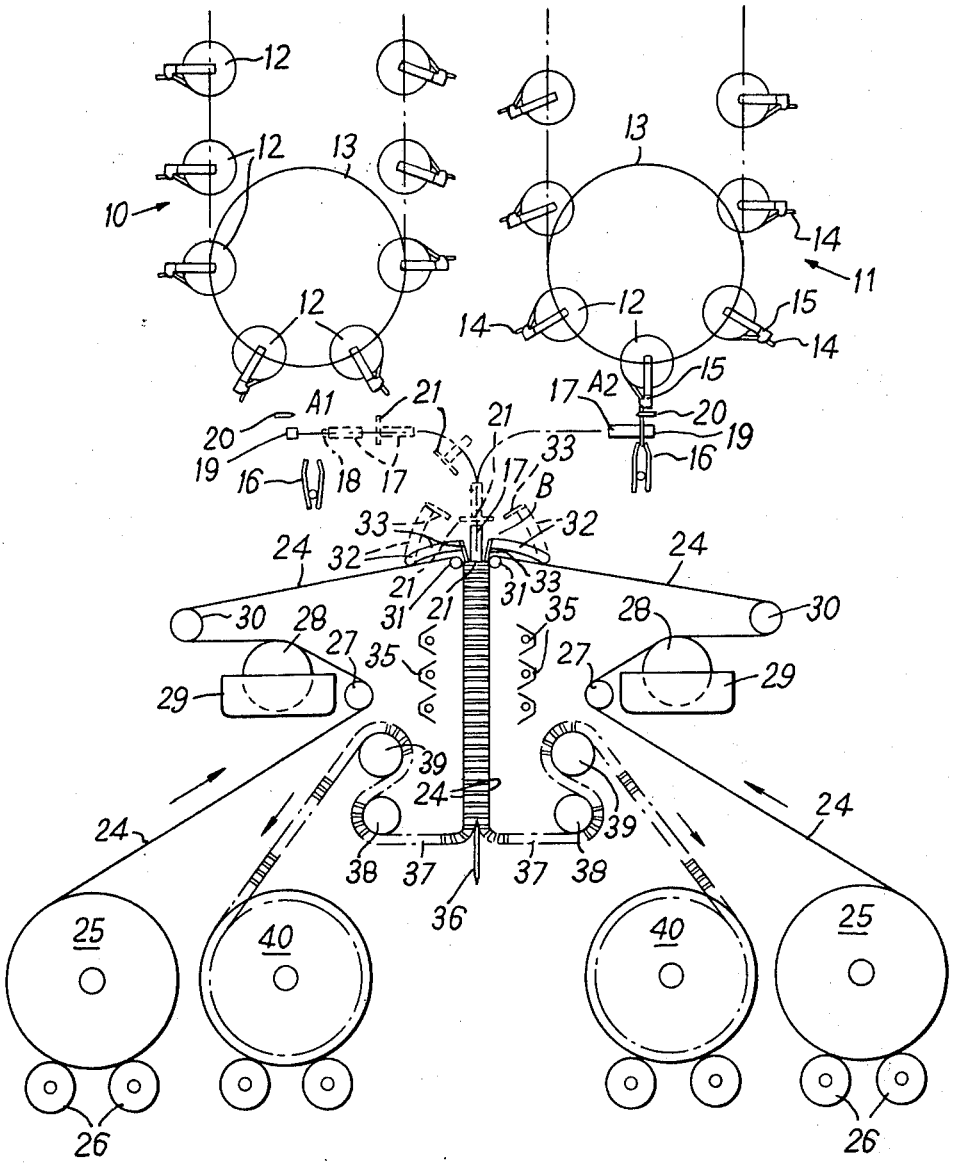
Figure 2:
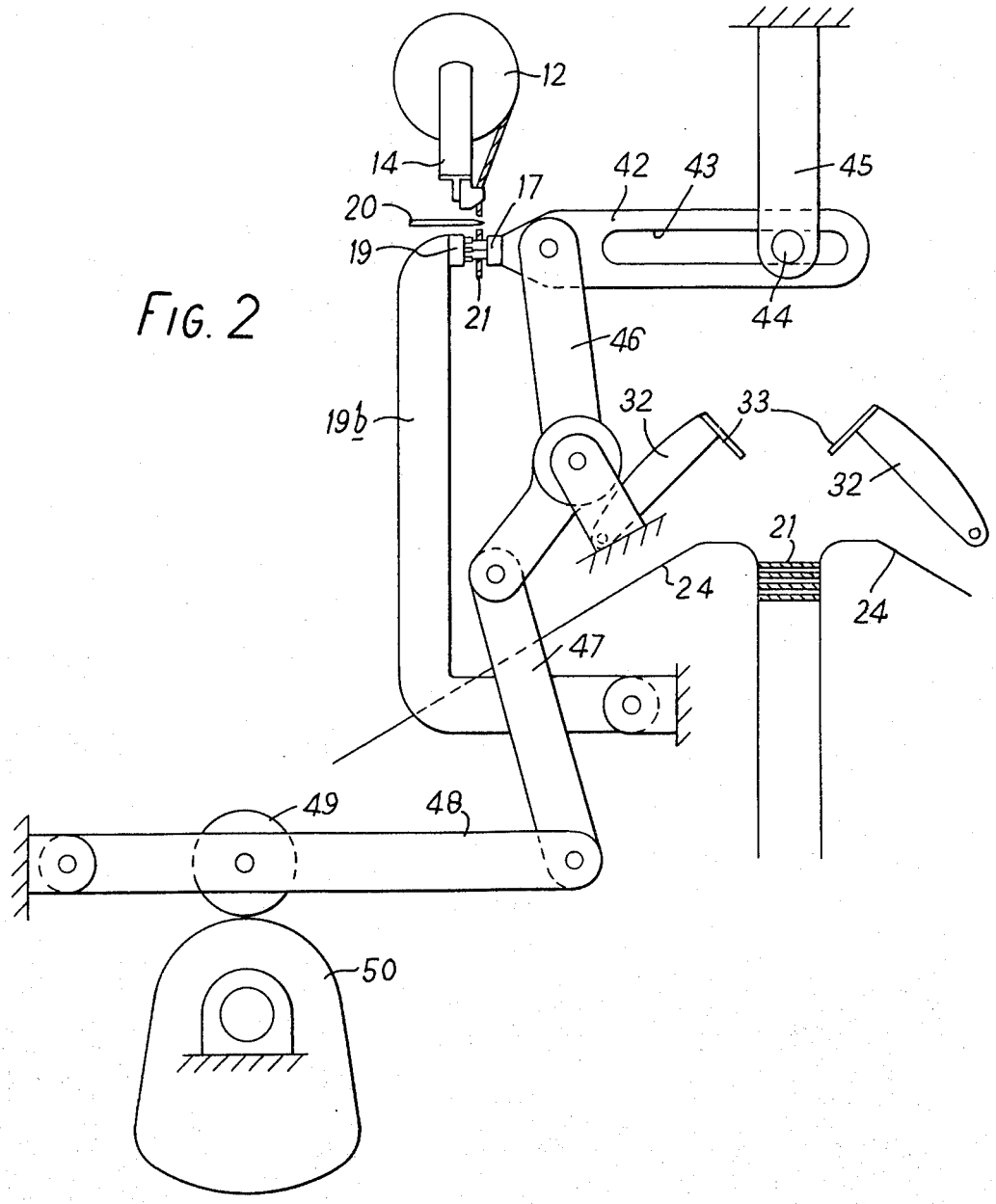
Figure 3:
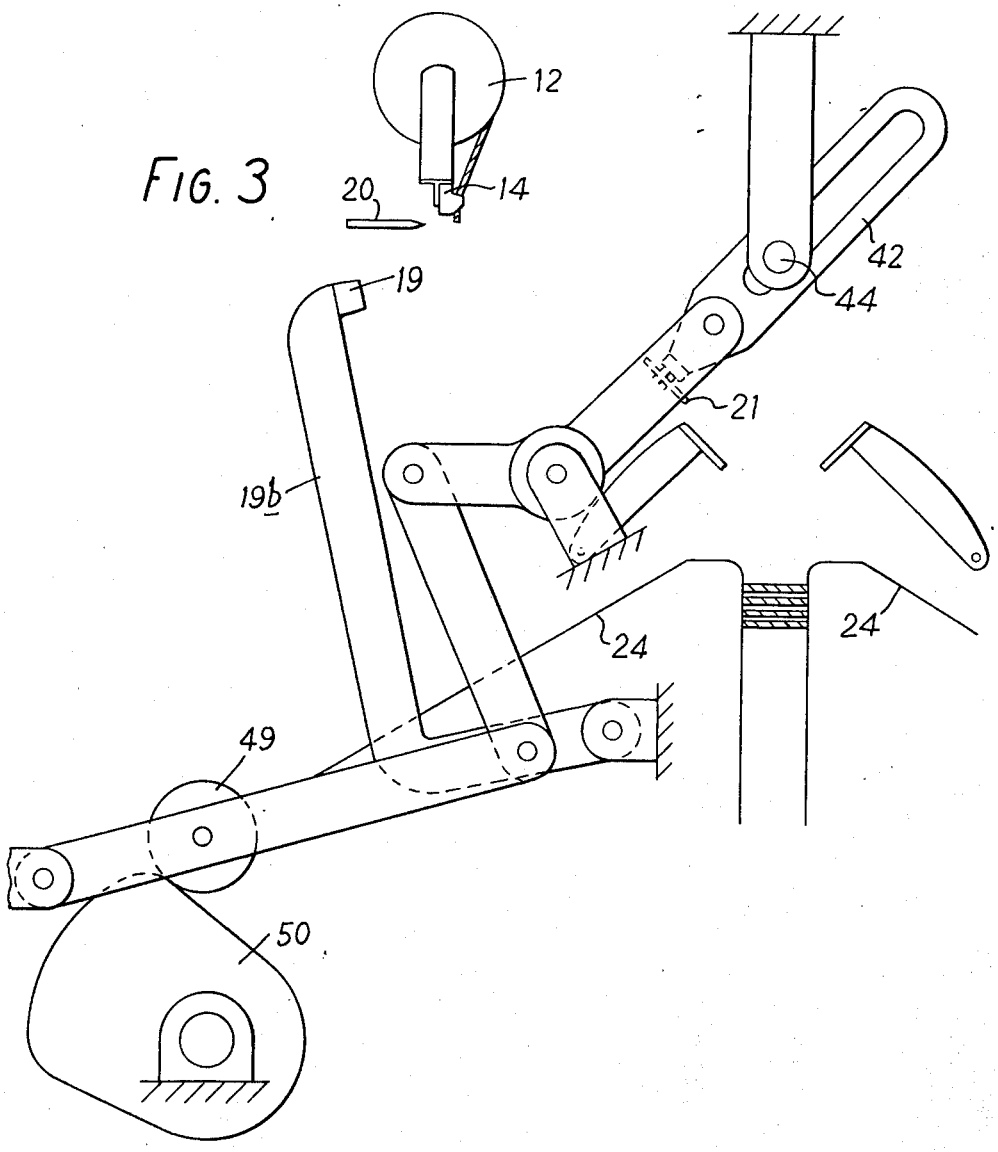
Figure 4:
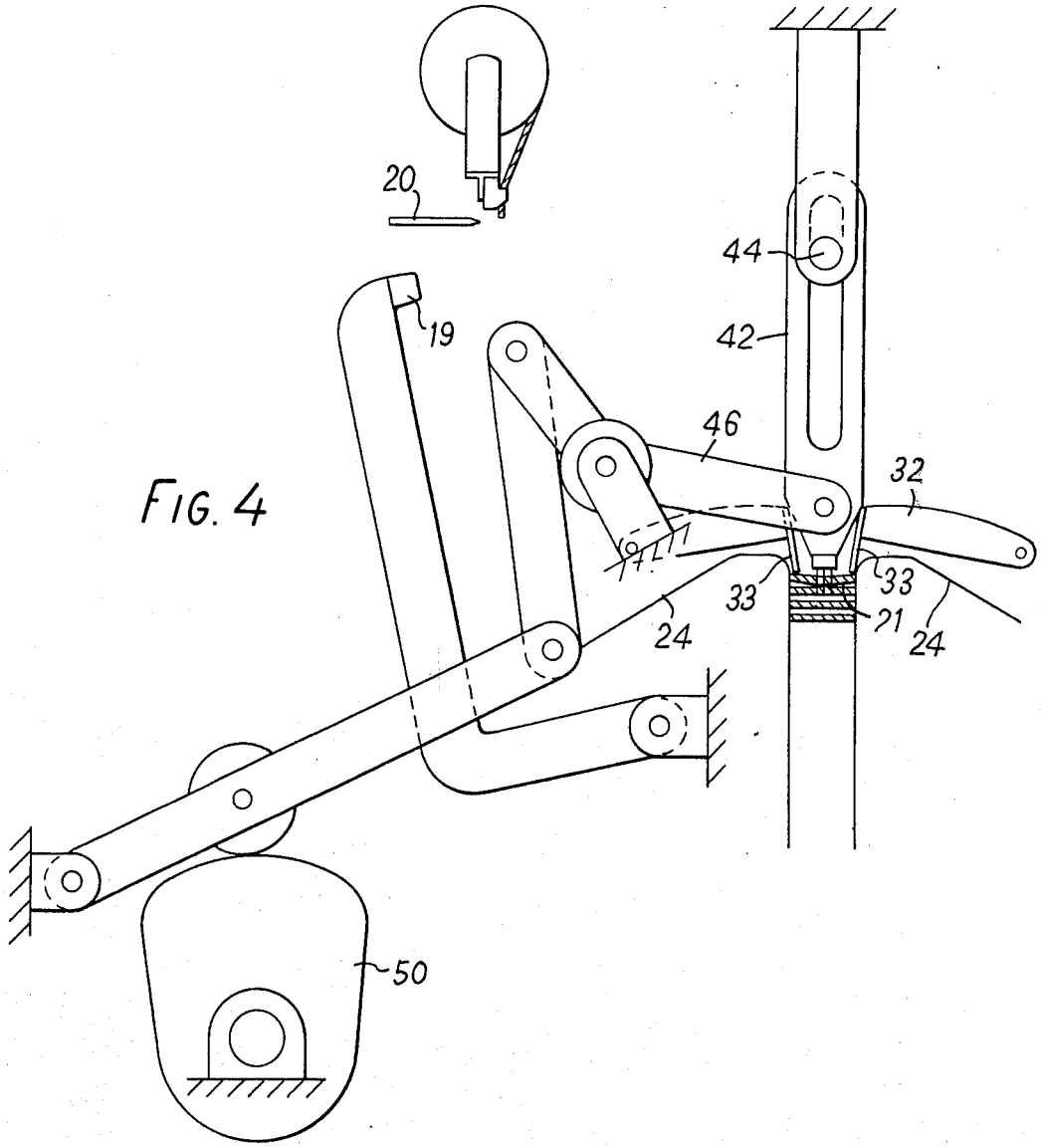
Figure 6:
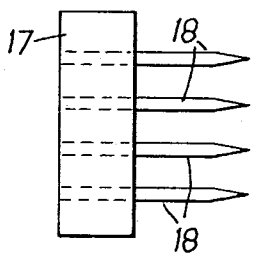
Figure 5:
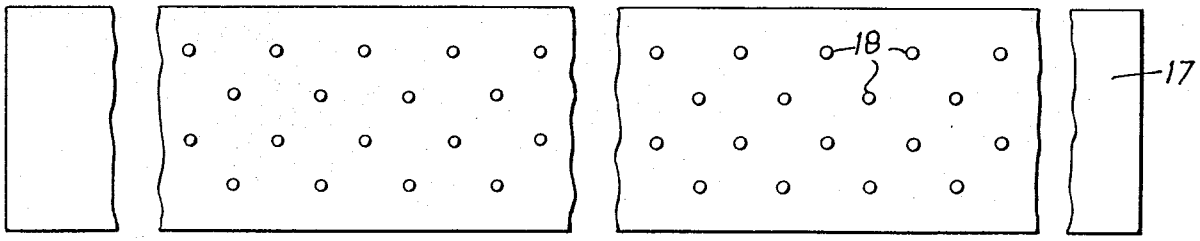
Figure 8:
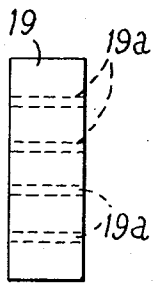
Figure 7:
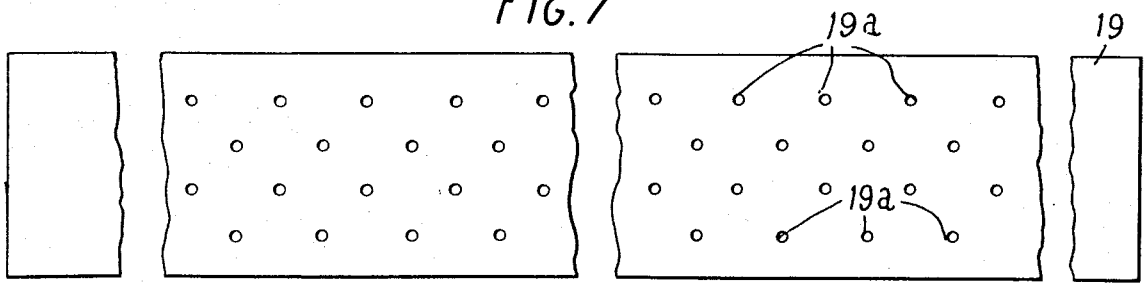
Figure 9:
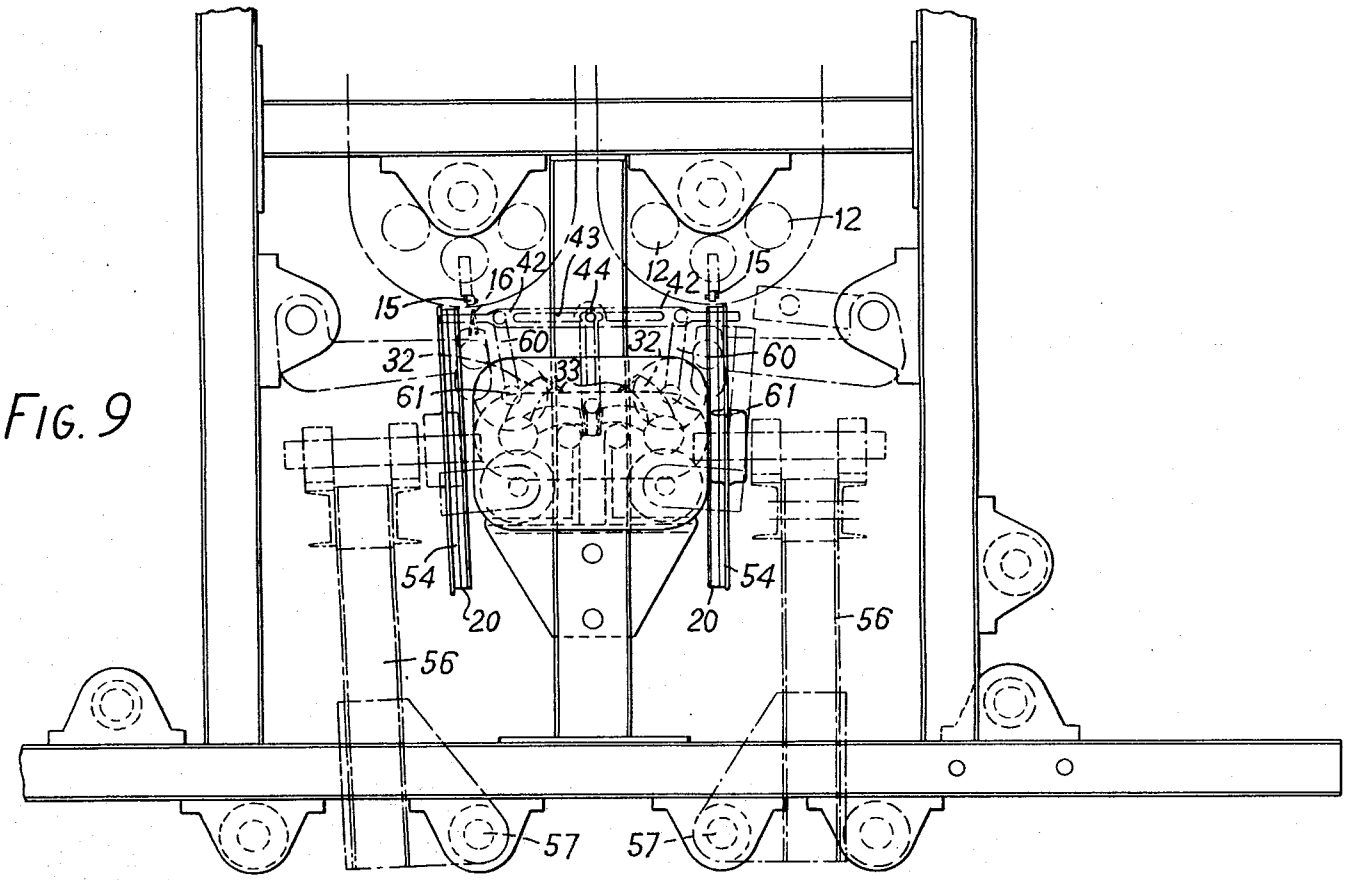
Figure 10:
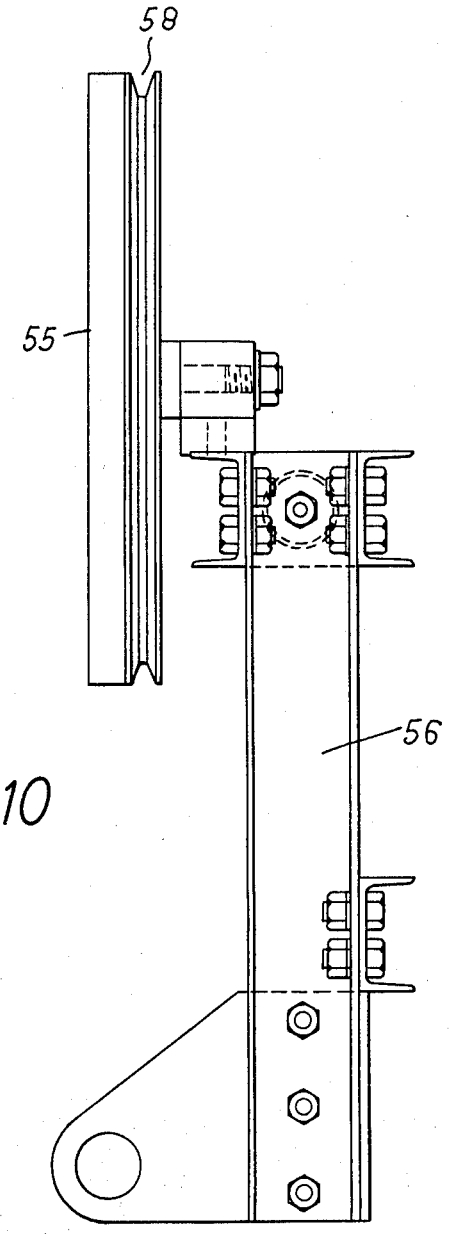

One embodiment of the invention will now be described by way of example with reference to the accompanying drawings in which:

FIG. 1 shows in diagrammatic form a machine according to the invention for manufacturing carpeting, FIGS. 2, 3, and 4 illustrate the sequence of operations in the cutting of the yarn ends and their transfer to the assembly station, FIGS. 5 and 6 respectively show an elevation and side elevation of the pin-carrying member of the machine, FIGS. 7 and 8 show views corresponding to FIGS. 5 and 6 respectively of the back-up member, FIG. 9 is an elevation of part of a machine according to the invention, and FIG. 10 is a side elevation of the band knife shown in FIG. 9.

Referring first to FIG. 1 of the drawings the invention is shown as applied in a carpet making machine in which pile yarn is supplied to a gripper station from a gantry comprising spools mounted in equally spaced relation to each other on chains which are carried on chain sprockets supported by a gantry frame as in spool Axminster looms. In this instance, however, two gantries 10, 11 are provided and are driven alternately through one full pitch of successive spools on the gantry, i.e. in steps equivalent to 60° of rotation of the lower chain sprockets 13 in the particular construction illustrated. Thus, spools 12 arrive alternately at gripper stations A1 and A2.

The yarn ends presented at stations A1 and A2 are dealt with in an identical manner by two sets of gripping means, knives and transfer mechanisms associated with the two stations respectively. Thus when a spool arrives at the gripping station A2 as shown the yarn ends 14 projecting in a row from the tube frame 15 of the spool are gripped by a pair of grippers 16 which are then moved downward a predetermined distance to draw lengths of yarn from the spool through the tube frame. Whilst the yarn ends are thus gripped, a transfer bar 17 carrying a multiplicity of pins 18, as shown in FIGS. 5 and 6, and a back-up member 19 are moved into engagement with the drawn portions of yarn from opposite sides of the row, and the drawn portions of yarn become impaled on the pins, the back-up member having a pattern of holes 19*a* (see FIGS. 7 and 8) into which the pins 18 move so that the back-up member ensures that the drawn yarn lengths are fully engaged on the pins. An endless band knife 20 is then moved transversely to the row of yarn lengths at a position above the pin-carrying bar 17 so as to cut off the drawn yarn lengths. The grippers are then operated to release the yarn ends, the back-up member 19 is retracted and the pin-carrying bar 17 with the impaled yarn lengths 21 is moved inward and then downward in an arcuate motion by a transfer mechanism to transfer the yarn lengths to the assembly station B where they are applied to two webs 24 of backing material.

The webs of backing material are unrolled from supply rolls 25 carried on rollers 26 and pass round rollers 27 and coating rollers 28 which dip into troughs 29 containing a bonding agent in the form of a paste made for example from foamed or unfoamed polyvinylchloride or foamed polyurethane, so that the paste is spread over one surface of each of the webs to produce a tacky coating having a uniform predetermined thickness. From the coating rollers 28 the webs pass round rollers 30 to rollers 31 at the assembly station B and pass thence vertically downwards.

In FIG. 1 the movement of the pin bar by the transfer mechanism is illustrated in relation to station A1 but a similar transfer mechanism operates the pin bar 17 associated with station A2. The transfer mechanism moves the pin bar 17 with its row of impaled yarn lengths 21 from station A2, where the yarn lengths are disposed vertically and swivels the bar so that at the assembly station B the yarn lengths extend horizontally. The yarn lengths project on both sides of the pin bar, and as the pin bar moves downward towards station B two wiper arms 32 disposed at opposite sides of station B and each carrying a blade 33 at its outer end move in behind the ends of the cut yarn lengths. The blades 33 extend along the full length of the row of yarn lengths 21. In the final position of the pin bar (shown in full lines) at the assembly station B the cut lengths of pile yarn 21 bridge the gap between the coated surfaces of the two webs 24 of backing material so that both ends of each yarn length become embedded in the coated surfaces of the respective webs of backing material. The wiper blades 33 stop at the position at which they are shown in full lines in FIG. 1 at the same time as the pin bar and remain in that position whilst the pin bar is withdrawn for return to station A2. The wiper blades ensure that the ends of successive rows of pile yarn lengths 21 are held in the bonding material in a strictly parallel arrangement and serve also to ensure that the pile yarn lengths are stripped from the pin bar as it leaves the assembly station B. After the pin bar has been moved away from the assembly station B the wiper blades are also retracted to their position shown in chain lines to await the arrival of the next row of yarn lengths, which has in the meantime been drawn and cut at station A1.

As the rows of yarn lengths 21 are attached to the webs of backing material, the double-plush carpeting thus formed passes vertically downwards between rows of radiant elements 35 which cure the bonding agent, and between cooling pipes (not shown) which subsequently cool the cured backing material. At the bottom end of the vertical run a knife 36, which may be an endless band knife, splits the double-plush carpeting as shown, and the two single plush webs 37 of carpeting thus formed are taken round rollers 38 and 39 and wound on to take-up rollers 40.

Referring now to FIGS. 2, 3 and 4, one suitable form of transfer mechanism is shown by way of example. In this construction the pin bar 17 is carried at one end of a link 42 having a lengthwise extending slot 43, and a pin 44 carried by a fixed part 45 of the machine engages rotatably and slidingly in the slot. A bell crank lever 46 pivotally mounted on a fixed part of the machine has one arm pivotally attached to the link 42 adjacent the pin bar and has its other arm connected by a link 47 to one end of a lever 48 the other end of which is mounted on a fixed part of the machine and which has intermediate its ends a roller follower 49 engaging a cam 50 driven by a main shaft of the machine. The geometry of the arrangement and the profile of the cam cause the link 42 initially to move substantially rectilinearly to the right from the position shown in FIG. 1, then to swivel in a counter-clockwise direction and simultaneously to slide with respect to the pivot 44 into the position shown in FIG. 3, and then to continue swivelling and to slide downwards into the position shown in FIG. 4 so that the final movement of the link to the assembly station B is approximately rectilinear.

The back-up member 19 is carried by a lever **19*b*** operated by a cam (not shown) to swivel the member towards and away from the drawn lengths of yarn.

It will be understood that there are a substantial number of alternative arrangements which could be employed to move the pin bars between the gripper stations A1 or A2, as the case may be, and the assembly station B.

FIGS. 5 and 6 show one form of pin bar which is employed, providing staggered pairs of pins for engaging the lengths of yarn. The pitch of the pairs of pins lengthwise of the bar is very much smaller than that of the yarn lengths, so that the same pin bar can be used whatever the pitch of the yarn lengths. If necessary a number of pin bars may be placed end to end according to the width of carpeting which is being manufactured. FIGS. 7 and 8 show the corresponding back-up bar with its holes arranged to receive the pins.

In alternative constructions, the pin bar and back-up bar may be replaced by mechanical nippers which grip the drawn lengths of yarn. Where speed of operation is not critical the pin and back-up bars may be replaced by a hollow bar with apertures opening to its front surface, vacuum being applied to the interior of the bar to hold the lengths of yarn to said surface by suction, the vacuum being released when the lengths of yarn are to be released.

Referring now to FIGS. 9 and 10, one arrangement of band knives is shown. Each band knife 20 is disposed about two pulleys 54, 55 which have cambered rims for the band. The pulleys are disposed beneath opposite axial ends of the associated gantry and are mounted on a rectangular sub-frame 56 which is pivotally mounted at 57 on the main frame of the machine so that oscillatory movement of the sub-frame about its pivots 57 brings the cutting edge on the upper run of the band into cutting engagement with the drawn lengths of yarn and then retract it. The oscillatory movement of the sub-frame is controlled by a cam (not shown) on a main shaft of the machine. A motor driven pulley (not shown) is disposed coaxially with the pivot axis of the sub-frame and drives the pulley 55 through an endless belt (not shown) which engage, a V-groove 58 on the pulley. An automatic sharpening device operates on the cutting edge of the band on its lower run.

Instead of providing two band knives 20 moving towards and away from each other, to cut the respective rows of drawn yarn lengths, a single band knife 20 with a double cutting edge may be disposed midway between the two gantries and swung to and fro to cut drawn yarn lengths at stations A1 and A2 alternately.

Although obviously the illustrated machine can be used to manufacture plain carpeting, it is primarily intended to produce patterned carpeting and can have full Axminster design facility. It will be understood that in order to produce the correct design, the individual spools have to be assembled on the two gantries in alternate design sequence.

In the illustrated arrangement, the gripper comprises two blades which extend over the full length of the row of yarn lengths but it may be necessary to provide two or more sets of blades arranged end to end in the case of wider looms. Similar considerations apply to the pin bars and back-up members. Individual pairs of nippers may be provided instead of the gripper blades.

There may be mounted on each of the gantries a bar (not shown) which is movable into and out of braking engagement with the wound yarn on the spool which is for the time being at the gripper station A1 or A2, so as to provide a reasonably uniform tension in the yarn during the drawing of the yarn by the grippers. The bar extends along the axial length of the spool and moves radially with respect to the spool at the gripper station. In operation, the bar is pressed against the wound yarn by low-rate compression springs. Additionally, means (not shown) may be provided which are engageable with each spool as it comes into the gripper station A1 or A2 to locate the spool accurately.

If desired, a single gantry or other mechanism for presenting a row of yarn ends at the gripper station can be employed with its associated pin bar and back-up member assembly and transfer mechanism, but the illustrated arrangement is preferred because the use of twin gantries, pin bars and transfer mechanisms alternately depositing rows of pile yarn lengths at the assembly station B to make two cut pile carpets simultaneously makes possible a relatively high rate of production whilst maintaining the speed of movement of the gantry chains, grippers and transfer mechanisms moderate and practical. The arrangements providing for yarn supply from two gripper stations alternately can of course be employed with advantage even in the manufacture of single pile carpets.

It will be understood that the means by which the yarn ends are presented at the gripper station is not material to this invention, and that each gantry chain can be replaced by a bank of bobbins supplying yarn to yarn-carriers controlled by a Jacquard, as in gripper Axminster looms, or can be supplied from a single continuous warp of yarn ends which are either plain or space dyed and which are fed off a large spool or beam.

We claim:

1. A machine for manufacturing carpeting comprising means for presenting ends of yarn in a row at a gripper station, means for releasably gripping the row of yarn ends at said station, means for moving the gripping means and presenting means one way from the other to draw the ends out to a predetermined extent, engaging means for supportingly engaging the drawn lengths of the yarn, means for cutting the drawn lengths of yarn at the side of the engaging means remote from the gripping means thereby to form cut lengths of yarn having first and second ends, means for moving the engaging means between the gripper station and an assembly station where said cut lengths of yarn are substantially straight and said first ends of said cut lengths of yarn supported by the engaging means are implanted in an adhesive surface of a web of backing material, said moving means being adapted to complete the moving of the cut lengths of yarn into engagement with said adhesive surface by moving the substantially straight cut lengths transversely of themselves and substantially parallel to said adhesive surface at the assembly station, and wiper means at the assembly station for holding said first ends of the lengths of yarn in engagement with said adhesive surface.

2. A machine as claimed in claim 1, wherein the carrier means comprises mechanical nippers for gripping the drawn lengths of yarn.

3. A machine for manufacturing carpeting comprising means for presenting ends of yarn in a row at a gripper station, means for releasably gripping the row of yarn ends at said station, means for moving the gripping means and presenting means one away from the other to draw the ends out to a predetermined extent, engaging means for supportingly engaging the drawn lengths of yarn, means for cutting the drawn lengths of yarn at the side of the engaging means remote from the gripping means, an assembly station wherein first and second webs of backing material are disposed, with each web having an adhesive surface facing the other web, means for moving the engaging means between the gripper station and said assembly station where one end of each length of yarn supported by said engaging means is implanted in the adhesive surface of said first web of backing material and the other end of each length of yarn supported by the engaging means is implanted in the adhesive surface of said second web, said moving means being adapted to complete the moving of the cut length of yarn into engagement with said adhesive surface by moving the cut length transversely of themselves and substantially parallel to said adhesive surface at the assembly station, and wiper means at the assembly station for holding said ends of lengths of yarn in engagement with said adhesive surface.

4. A machine for manufacturing carpeting comprising means for presenting ends of yarn in a row at a gripper station, means for releasably gripping the row of yarn ends at said station, means for moving the gripping means and presenting means one away from the other to draw the ends out to a predetermined extent, engaging means for supportingly engaging the drawn lengths of yarn, said engaging means comprising a transfer bar provided with pins for impaling the drawn lengths of yarn, means for cutting the drawn lengths of yarn at the side of the engaging means remote from the gripping means, means for moving the engaging means between the gripper station and an assembly station where said lengths of yarn supported by the engaging means each have an end implanted in an adhesive surface of a web of backing material, said moving means being adapted to complete the moving of the cut lengths of yarn into engagement with said adhesive surface by moving the cut lengths transversely of themselves and substantially parallel to said adhesive surface at the assembly station, and wiper means at the assembly station for holding said ends of the lengths of yarn in engagement with said adhesive surface.

5. A machine as claimed in claim 4, wherein the pins project perpendicularly from a surface of the transfer bar, and wherein a back-up is provided which co-operates with the bar and provides a surface provided with apertures for accommodating the pins, the bar and the back-up member being initially disposed at opposite sides of the drawn lengths of yarn and being movable into and out of engagement with each other at the gripper station.

6. A machine for manufacturing carpeting comprising means for presenting ends of yarn in a row at a gripper station, means for releasably gripping the row of yarn ends at said gripper station, means for moving the gripping means and presenting means one away from the other to draw the ends out to a predetermined extent, engaging means for supportingly engaging the drawn lengths of yarn, said engaging means comprising a hollow bar extending along a row of drawn lengths of yarn and having apertures facing said drawn lengths, suction means connected to the hollow interior of the bar for holding the lengths of yarn against said apertures by suction, and means operable to cause a suction effect of the suction means in said hollow interior to be terminated, means for cutting the drawn lengths of yarn at the side of said engaging means remote from the gripping means, means for moving said engaging means between said gripper station and an assembly station where said lengths of yarn supported by the engaging means each have an end implanted in an adhesive surface of a web of backing material, said moving means being adapted to complete the moving of the cut lengths of yarn into engagement with said adhesive surface by moving the cut lengths transversely of themselves and substantially parallel to said adhesive surface at said assembly station, and wiper means at said assembly station for holding said ends of the lengths of yarn in engagement with said adhesive surface.

7. A machine for manufacturing carpeting comprising first and second means for presenting ends of yarn in a row at first and second gripper stations respectively, first and second means for releasably gripping the row of yarn ends at said first and second gripper stations respectively, first and second means for moving said first gripping means and first presenting means one away from the other and said second gripping means and second presenting means one away from the other respectively to draw the ends out to a predetermined extent, first and second engaging means for supportingly engaging the drawn lengths of yarn held by said first and second gripping means respectively, first and second means for cutting the drawn lengths of yarn at a side of said first and second engaging means remote from said first and second gripping means respectively, first and second means for moving said first and second engaging means respectively between the respective gripper station and assembly station where said lengths of yarn supported by said first and second engaging means each have an end implanted in an adhesive surface of a web of backing material, such that rows of drawn lengths of yarn from the first and second gripper stations alternately are presented at the assembly station for implanting in said adhesive surface, said first and second moving means being adapted to complete the moving of the cut lengths of yarn into engagement with said adhesive surface by moving the cut lengths transversely of themselves and substantially parallel to said adhesive surface at said assembly station, and wiper means at said assembly station for holding said ends of the lengths of yarn in engagement with said adhesive surface.

8. A machine as claimed in claim 7, wherein the wiper means at the assembly station includes blade elements which are operated to follow each impaled length of yarn as it reaches the assembly station and to press the ends of the impaled length of yarn into said adhesive surface of the backing material.

* * * * *